United States Patent [19]

Suzuki et al.

[11] 4,009,957

[45] Mar. 1, 1977

[54] COPY PAPER FEED SYSTEM

[75] Inventors: Shigeru Suzuki; Minoru Iwamoto; Koichi Noguchi; Kyoji Omi; Tatsuo Nishikawa, all of Tokyo, Japan

[73] Assignee: Ricoh Co., Ltd., Tokyo, Japan

[22] Filed: Nov. 7, 1974

[21] Appl. No.: 521,822

[30] Foreign Application Priority Data

Dec. 27, 1973 Japan ..... 49-2080

[52] U.S. Cl. ..... 355/14; 96/1 R; 156/351; 156/366; 156/368; 307/2; 355/8

[51] Int. Cl.[2] ..... G03G 15/28; G03G 15/32

[58] Field of Search ..... 156/351, 366, 368; 355/14, 7, 8, 25, 15, 31; 96/1 R; 317/2 L; 307/2

[56] References Cited

UNITED STATES PATENTS

| | | | |
|---|---|---|---|
| 3,602,589 | 8/1971 | Dietz | 355/14 |
| 3,655,283 | 4/1972 | Marqulis | 355/14 |
| 3,677,635 | 7/1972 | Van Auken et al. | 355/25 |
| 3,804,512 | 4/1974 | Komori et al. | 355/25 |

*Primary Examiner*—Edward E. Whitby
*Attorney, Agent, or Firm*—Frank J. Jordan

[57] ABSTRACT

As a scanning element of an electrophotographic copying machine begins to move, a feed roller moves a sheet of copy paper into the bite of register rollers which are held stationary. This movement of the copy paper is accomplished in a period of time which is less than that required for the scanning element to reach a predetermined scan synchronizing point. The feed roller is then stopped so that the copy paper is slightly buckled and thereby resiliently urged into the bite of the register rollers. When the scanning element reaches the scan synchronizing point, a sensor causes the register rollers to rotate thereby feeding the copy sheet through the machine in synchronization with the movement of the scanning element. The copy machine may employ a seamless photoconductive drum or belt moving at constant speed in which case an electrostatic image is formed on the drum or belt by the scanning element. The image is developed by toner particles and transferred to the copy sheet. The copy machine may also be of the type in which the copy sheet itself is photoconductive and is imaged directly by the scanning element.

9 Claims, 13 Drawing Figures

COPY PAPER FEED SYSTEM

The present invention relates to a copy sheet feed method and apparatus for an electrophotographic copying machine.

In a typical electrophotographic copying machine, a scanning system scans an original document to image a rotating photoconductive drum. Toner particles are applied to the drum to develop the image and a copy sheet is fed in contact with the drum to have the toner image transferred thereto.

In order to synchronize the initial contact of the copy sheet with the drum to ensure that the toner image is properly centered or registered on the copy sheet, it is known in the art to provide a system of feed rollers and register rollers to feed the copy sheet from a stack to the drum in two stages. The register rollers are located adjacent to the drum and are initially stopped. The feed rollers are energized as the scan starts to feed a copy sheet from the stack so that the leading edge of the sheet engages with the bite of the register rollers. The feed rollers are stopped when the sheet buckles slightly and is thereby resiliently urged into the bite of the register rollers. When the drum has reached a predetermined position, the register rollers are driven to feed the copy sheet into contact with the drum in correct synchronization.

The feed and register rollers may be controlled by means of switches actuated by cams fixed for rotation with the drum as disclosed in U.S. Pat. No. 3,804,512 if the rotation of the drum is synchronized with the scanning operation. By synchronization in this case it is meant that the scanning system and drum are moved in a predetermined orientation relative to each other whereby a given position on the drum corresponds to a given position of the scanning means during any copying operation.

However, when a seamless photoconductive drum or belt is driven at constant speed, the above method of synchronizing the sheet feed by sensing the position of the drum or belt cannot be utilized since the relationship between the orientation of a given position on the drum or belt and the position of the scanning means is random, or unsynchronized. A prior art system for sheet feed synchronization which may be applied to such a copy machine is disclosed in U.S. Pat. No. 2,945,434, in which the drive of the register rollers is begun at a predetermined time after the scanning is initiated. This system in critical applications fails to provide adequate synchronization of the sheet feed due to backlash and clutch slippage in the scan drive system, inaccuracy of the register roller timing means, and similar practical factors.

It is therefore an object of the present invention to provide a simple and accurate method of synchronizing the sheet feed of a copying machine with the scanning operation thereof which overcomes the above drawbacks of the prior art.

It is another object of the present invention to provide accurate synchronization of the sheet feed and scanning in a copying machine by sensing the scanning position.

It is another object of the present invention to provide novel apparatus embodying the above objects.

The above and other objects, features and advantages of the present invention will become clear from the following detailed description taken with the accompanying drawings, in which.

Figure 1:
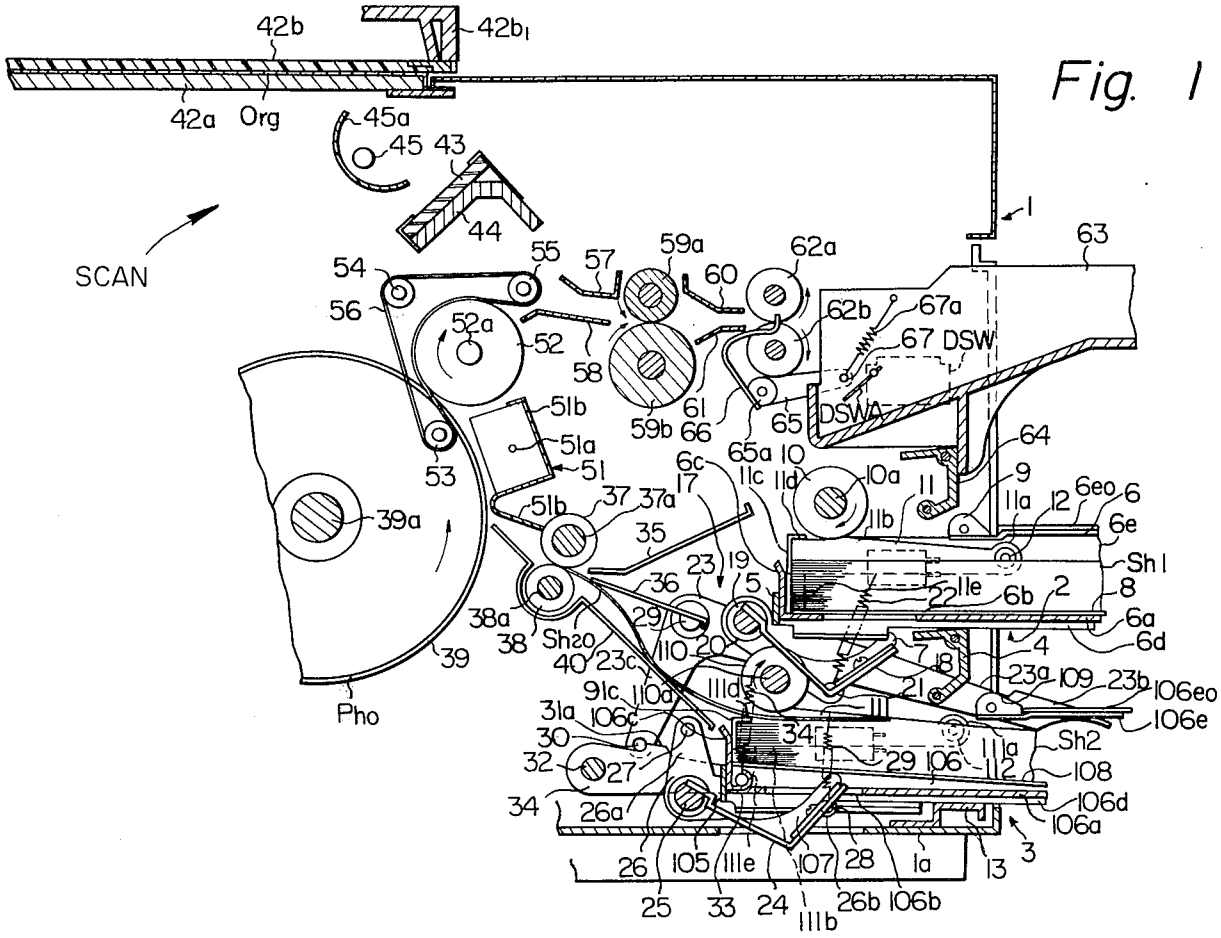
FIG. 1 is a fragmentary longitudinal section of a copying machine incorporating a copy sheet feed apparatus embodying the present invention.

Referring now to FIG. 1, a copy machine incorporating an embodiment of the present invention comprises a frame 1 having openings 2 and 3 for copy sheet cassettes. A cassette 6 is received in the opening 2 and supported by a support member 4. The left end of the cassette 6 is aligned by abutment against an abutment member 5 fixed to the frame 1. A cassette 106 is received in the opening 3 and is supported by a channel member 13 fixed to the frame 1. The left end of the cassette 106 abuts against an abutment member 105 fixed to the frame 1. The cassette 6 is adapted to house copy sheets $Sh_1$ of A5 size whereas the cassette 106 is adapted to house copy sheets $Sh_2$ of B5 size.

Figure 2:
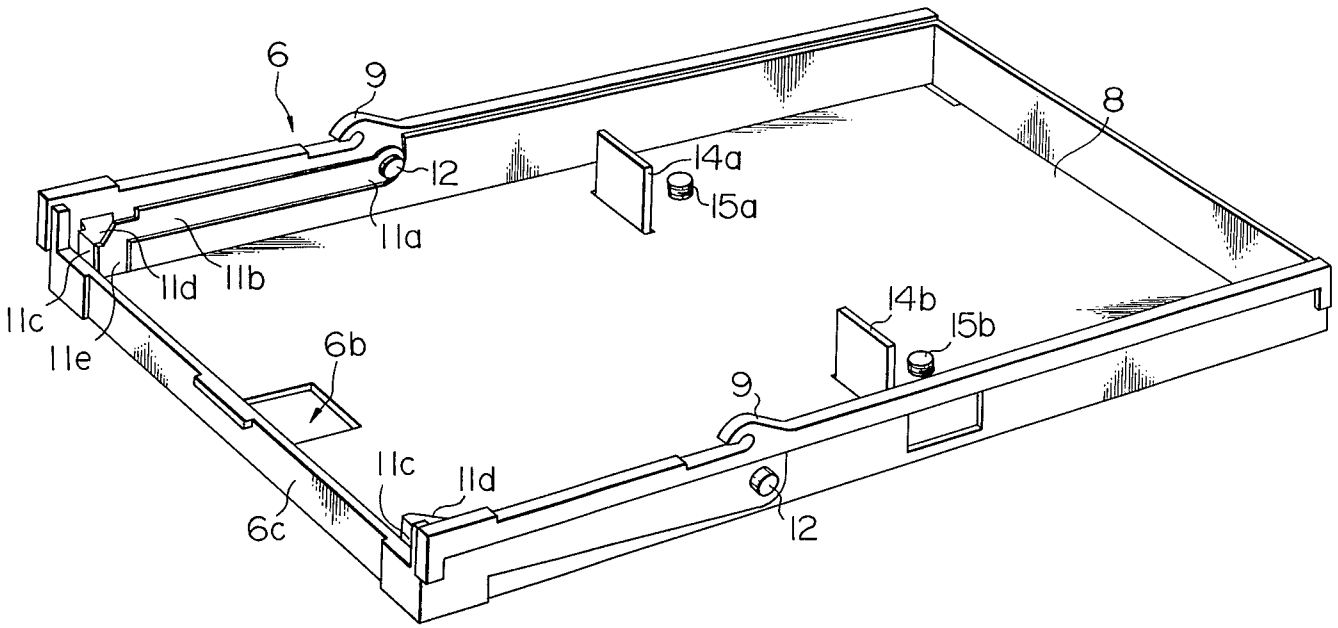
FIG. 2 is a perspective view of the upper portion of a copy sheet cassette used in the copy machine shown in FIG. 1.
Figure 3:
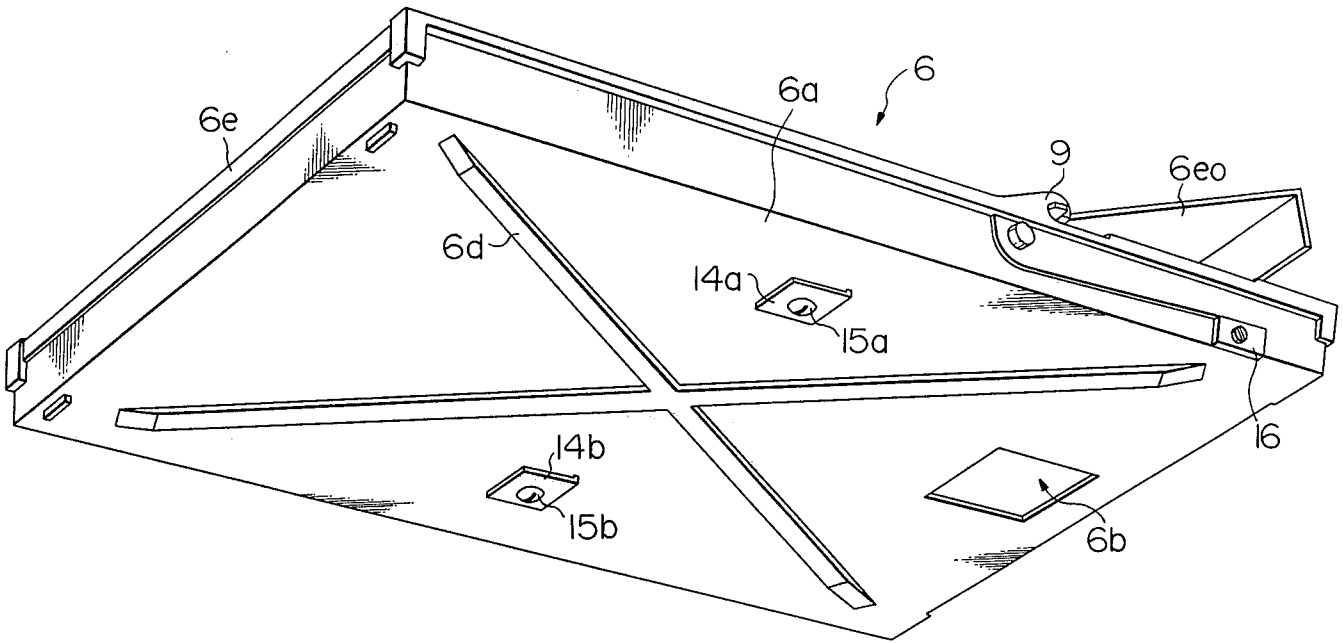
FIG. 3 is a perspective of the lower portion of the cassette shown in FIG. 2.

The cassette 6 is shown in FIGS. 2 and 3, and comprises a bottom wall **6*a* with a rectangular hole 6*b* formed therethrough. The cassette 6 has side walls and a rear wall (no numerals) and a front wall 6*c* adapted to abut against the abutment member 5. The bottom wall 6*a* is formed with a rib 6*d* which rests on the support member 4. A lid 6*e* is provided for the cassette 6, and has a front portion 6eo which is openable by means of a hinge 9**.

Pawl members 11 are pivotally connected to the inner side walls of the cassette 6 by pins 12 at their ends **11*a*. Elongated portions 11*b* of the pawl members 11 extend up to free ends 11*c* which are adjacent to the front wall 6*c* and are bent parallel to the front wall 6*c*. Separator portions 11*d* are fixed to the ends 11*c* and rest on the forward or leading corners of the sheets $Sh_1$. A plate 8 is laid on the bottom wall 6*a* of the cassette 6** to support the sheets $Sh_1$, and the pawl members 11 are formed at the ends 11*c* with downwardly extending arms 11*e* which rest on the plate 8 when the cassette 6 is empty.

The cassette 6 may also house copy sheets of A6 size, or half the size of the A5 sheets $Sh_1$ by means of partition members 14*a* and 14*b* fixed to the bottom wall 6*a* by screws 15*a* and 15*b* respectively and which pass through holes (now shown) in the plate 8. When half size sheets are employed, an indicator plate 16 is fixed to a side wall of the cassette 6.

The cassette 106 is provided with elements designated 106*a* to 106*e*, 106*eo*, 108, 109, 111*a* to 111*e*, 114*a*, 114*b*, 115*a*, 115*b* and 116 which are identical in construction but different in size from the elements designated 6*a* to 6*e*, 6*eo*, 8, 9, 11*a* to 11*e*, 14*a*, 14*b*, 15*a*, 15*b* and 116 respectively. The partition members 114*a* and 114*b* and indicator plate 116 allow the cassette 106 to house sheets of B6 size, or half the size of the B5 sheets $Sh_2$.

As shown in FIG. 1, a shaft 19 is rotatably supported by the frame 1 and has a raising lever 7 and an arm 20 fixed thereto. The arm 20 and thereby the shaft 19 and raising lever 7 are biased in a counterclockwise direction by a tension spring 22 connected at opposite ends to the frame 1 and a pin 21 fixed to the arm 20. A shaft 29 is rotatably supported by the frame 1 and has a selector lever 23 fixed thereto. An arm 23*a* of the selector lever 23 is provided with a handle 23*b* which extends externally through the right side of the frame 1 and an arm 23*c* extending at a right angle to the arm 23*a*. As viewed in FIG. 1, the pin 21 abuts against the bottom of the arm 23*a* of the selector lever 23.

A shaft 25 is rotatably supported by the frame 1 and has a raising lever 107 and a lever 26 fixed thereto. The lever 26 has arms 26*a* and 26*b* at right angles to each other which carry pins 27 and 28 at their respective ends. The lever 26 and thereby the shaft 25 and raising lever 107 are biased counterclockwise by a tension spring 24 connected at its ends to the frame 1 and the pin 28.

A shaft 32 is rotatably supported by the frame 1 and has a detent arm 31 fixed thereto. A pin 33 is fixed to the end of the detent arm 31, and a tension spring 34 is connected at its ends to the frame 1 and the pin 33 to bias the detent arm 31 counterclockwise. The detent arm 31 is formed with a projection 31*a* which, in conjunction with a pin 30 fixed to the end of the arm 23*c* of the lever 23, performs the detent function as will be described in detail below. Guide plates 35 and 40 are fixed to the frame 1, and a movable guide plate 36 is fixed to the lever 23.

Separator or feed rollers 10 and 110 are fixed to rotary shafts 10*a* and 110*a* and disposed over the cassettes 6 and 106 respectively. The selector lever 23 is used to select which of the cassettes 6 and 106 is to be utilized in the copying operation. As viewed in FIG. 1, the selector lever 23 is rotated clockwise to select the cassette 106. Specifically, since the pin 30 is disengaged from the arm 26*a*, the lever 26 is rotated counterclockwise by the spring 24 so that the end of the raising lever 107 enters through the hole 106*b* of the cassette 106 and pushes the plate 108 and sheets $Sh_2$ up into engagement with the feed roller 110. When the feed roller 110 is rotated by means to be described below, the top sheet $Sh_{20}$ of the sheets $Sh_2$ is separated from the remainder of the sheets $Sh_2$ by the feed roller 110 and separator portions 111*d* of the pawl members 111 of the cassette 106 and fed between the guide plates 36 and 40 so that the leading edge of the sheet $Sh_{20}$ enters the bite of register rollers 37 and 38 fixed to rotary shafts 37*a* and 38*a* respectively. The selector lever 23 is held in its maximum clockwise position by the left side of the projection 31*a* of the detent arm 31 engaging with the pin 30. The bottom of the arm 23*a* of the selector lever 23 engages with the pin 21 fixed to the arm 20 to rotate the arm 20, shaft 19 and raising lever 7 clockwise against the force of the spring 22. By this action, the end of the raising lever 7 is retracted from the hole 6*b* of the cassette 6 so that the plate 8 and sheets $Sh_1$ are not raised thereby and the top sheet $Sh_{10}$ of the sheets $Sh_1$ does not contact the feed roller 10.

Figure 4:
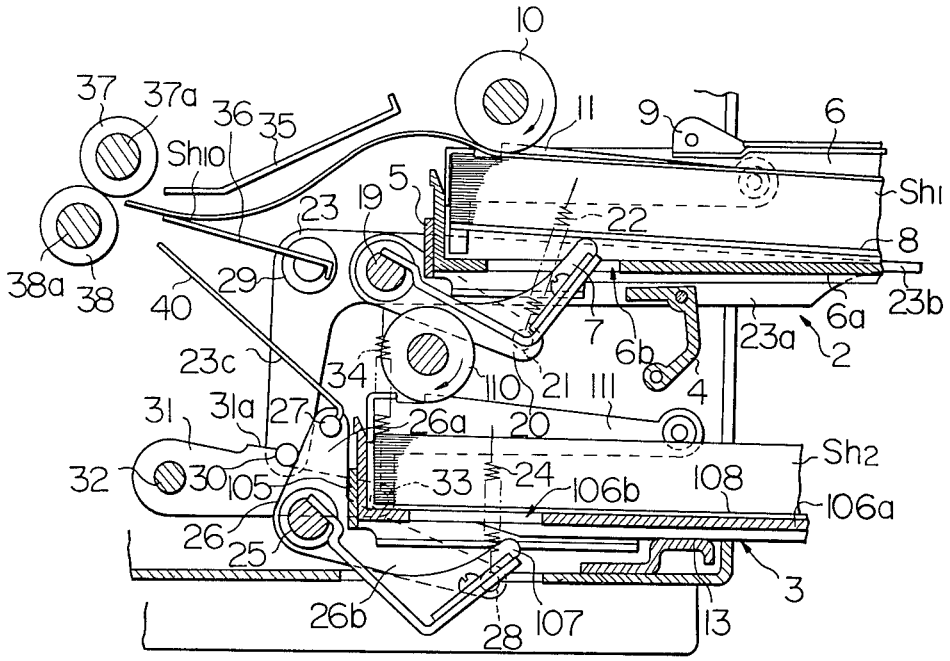
FIG. 4 is a fragmentary longitudinal section of the copy machine and copy sheet feed apparatus shown in FIG. 1.

To select the cassette 6 rather than the cassette 106, the selector lever 23 is rotated counterclockwise to the position shown in FIG. 4. Due to the counterclockwise rotation of the selector lever 23, the bottom of the arm 23*a* of the selector lever 23 disengages from the pin 21 fixed to the arm 20 so that the arm 20, shaft 19 and raising lever 7 are rotated counterclockwise by the force of the spring 22. The end of the raising lever 7 enters the hole 6*b* of the cassette 6 and pushes the plate 8 and sheets $Sh_1$ upward so that the top sheet $Sh_1$ contacts the feed roller 10. As the selector lever 23 is rotated counterclockwise, the pin 30 will apply a downward force to the detent arm 31 against the force of the spring 34 and move from the left edge of the projection 31*a* onto the top of the projection 31*a*. The detent arm 31 will rotate slightly clockwise and the right side of the arm 23*c* of the selector lever 23 will engage with the pin 27 to rotate the lever 26, shaft 25 and raising lever 107 clockwise. Upon further rotation of the selector lever 23, the pin 30 will contact the left side of the arm 26*a* of the lever 26. The pin 27 will disengage from the arm 23*c* and the pin 30 will cause the lever 26 to rotate even further clockwise. As the pin 30 passes over the upper right corner of the projection 31*a*, the detent arm 31 will be rotated counterclockwise by the spring 34 so that the pin 30 will engage with the right side of the projection 31*a* and be held in its maximum counterclockwise position. The clockwise rotation of the lever 26 causes the end of the raising lever 107 to retract from the hole 106*b* of the cassette 106 so that the sheets $Sh_2$ are moved out of engagement with the feed roller 110. When the feed roller 10 is driven, the top sheet $Sh_{10}$ of the sheets $Sh_1$ will be fed between the guide plates 35 and 36 into the bite of the register rollers 37 and 38.

In accordance with the present invention, the register rollers 37 and 38 are stopped before the leading edge of a sheet reaches the bite thereof. The feed rollers 10 and 110 are driven until the leading edge of a sheet reaches the bite of the register rollers 37 and 38 and then slightly more so that the sheet is slightly buckled and thereby resiliently urged into the bite of the register rollers 37 and 38 as shown in FIGS. 1 and 4.

The copy machine further comprises a seamless photoconductive drum 39 coated with a photoconductive material Pho such as selenium, zinc oxide, cadmium sulfide or poly-N-vinylcarbazole. The drum 39 is mounted on a shaft 39*a* which is driven for constant speed rotation by a motor M (FIG. 11) in the counterclockwise direction.

Figure 6:
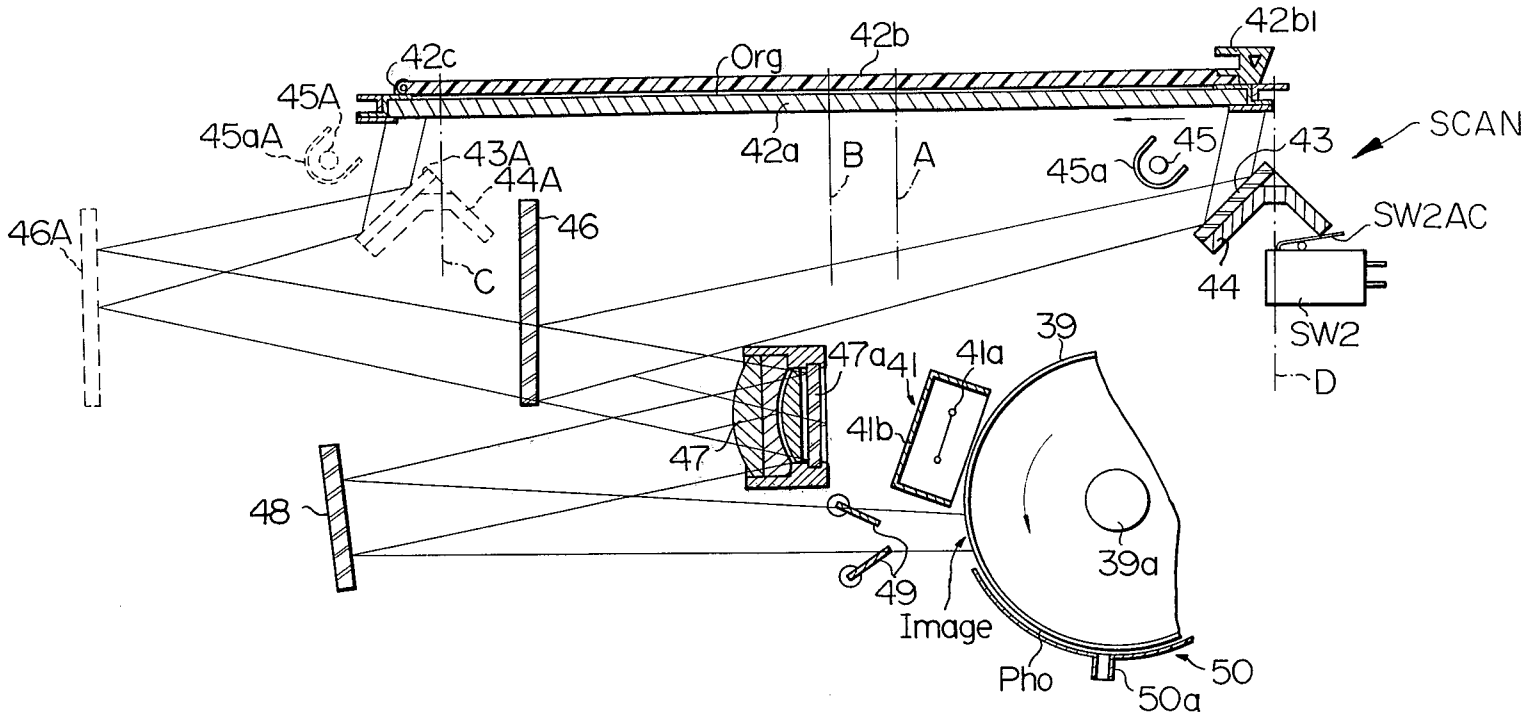
FIG. 6 is a fragmentary longitudinal section illustrating another portion of the copy machine shown in FIG. 1.

Referring also to FIG. 6, an original document Org to be copied is placed face down on a transparent plate 42*a*, which is rigidly supported horizontally by the frame 1. A cover 42*b* is provided for the document Org, which is hinged to the frame 1 at its left edge by a pin 42*c* and has a handle 42*b*$_1$ at its right free end. A scanning system SCAN comprises a lamp 45 and a reflector 45*a* arranged to direct light from the lamp 45 onto the bottom surface of the document Org, a plane mirror 43 mounted on a support 44 at an angle to the document Org and another plane mirror 46 vertically arranged to the left of the plane mirror 43. A lens 47 is rigidly mounted on the frame 1 below and to the right of the mirror 46. A plane mirror 47*a* is held in place behind (to the right of) the lens 47. Another plane mirror 48 is fixed to the left of and below the lens 47, and plates 49 are arranged to the right of the mirror 48 and adjacent to the drum 39 to define a slit.

The scanning system SCAN is mounted on a horizontal frame which slides on horizontal guide rails (not shown) for horizontal movement leftward and rightward as viewed in FIG. 6. In operation, prior to scanning, the scanning system SCAN is in the position indicated in solid line at the right of FIG. 6 in which a plane D passes through the rightmost corner of the mirror 43. In response to a scan start signal, the mirror 43, support 44, lamp 45 and reflector 45*a* are moved leftward at a speed proportional to the constant rotational speed of the drum 39. The mirror 46 is moved leftward at a speed half that of the mirror 43, support 44, lamp 45 and reflector 45*a*. An image of the portion of the document Org directly above the mirror 43 is reflected from the mirror 43 to the mirror 46, from the mirror 46 through the lens 47 to the mirror 47*a*, from the mirror 47*a* back through the lens 47 to the mirror 48, and from the mirror 48 through the slit defined by the plates 49 onto the surface of the drum 39 at a position designated as IMAGE. The leftward direction of movement of the scanning system SCAN is called the scan or advance direction, and the scan movement ends at the position shown in broken line at which the mirror 43, support 44, lamp 45, reflector 45*a* and mirror 46 are designated as 43A, 44A, 45A, 45*a*A and 46A respectively. A plane C passes through the rightmost corner of the mirror 43A. After the scan movement is completed, the scanning system SCAN moves rightward back to its original position. The rightward direction of movement of the scanning system SCAN is the retrace or return direction. Simultaneous movement of the drum 39 and scanning system SCAN will cause an electrostatic image of the document Org to be formed on the drum 39 as is well known in the art. The scanning system SCAN per se is not to be considered as a novel feature of the present invention, and is exemplary only. Any scanning system comprising an element which moves during scanning may be used within the scope of the invention.

Arranged above the point IMAGE is a charging unit 41 comprising a corona discharge electrode 41*a* and a shield 41*b*. Below the point IMAGE is disposed a developing tray 50 in close proximity to the circumference of the drum 39. The tray has an inlet 50*a* through which developing liquid containing charged toner particles is adapted to be introduced.

Referring again to FIG. 1, a transfer charging unit 51 is arranged to the right of the drum 39 and above the guide plate 40. The transfer charging unit 51 comprises a corona discharge electrode 51*a* and a shield 51*b*. The bottom portion of the shield 51*b* is bent to serve as a guide plate which cooperates with the guide plate 40. Above the transfer charging unit 51 is disposed a belt drive roller 52 mounted on a rotary shaft 52*a*. A narrow belt 56 is trained over the belt drive roller 52 and guide rollers 53, 54 and 55. The roller 52 is substantially coextensive with the drum 39, but the roller 53 is disposed beyond the end of the drum 39. The rollers 54 and 55 are disposed near the end of the roller 52. The belt 56 is thereby twisted so that it approaches the drum 39 from beyond the end of the drum 39 from the roller 53, moves along the circumference of the drum 39 in a generally helical manner and separates from the circumference of the drum 39 to be trained around the roller 52. Although not shown, a similar belt assembly comprising a belt and rollers identical to the best 56 and rollers 53, 54 and 55 may be disposed at the other end of the drum 39 which is commonly driven by the roller 52.

Guide plates 57 and 58 are fixed to the frame 1 to the right of the roller 55. Heated fixing rollers 59*a* and 59*b* are disposed to the right of the guide plates 57 and 58. Guide plates 60 and 61 are fixed to the frame 1 to the right of the fixing rollers 59*a* and 59*b*, and discharge rollers 62*a* and 62*b* are disposed to the right of the guide plates 60 and 61. A collecting tray 63 is disposed to the right of the discharge rollers 62*a* and 62*b* and is supported by support member 64 fixed to the frame 1.

An actuator arm 65 is mounted on a shaft 65*a* rotatably supported by the frame 1. A pin 67 is fixed to the end of the actuator arm 65, and a weak tension spring 67*a* is connected at its ends to the frame 1 and the pin 67 to urge the top of the actuator arm 65 counterclockwise to abut against a pin 67*b* fixed to the frame 1. The length of the rollers 62*a* and 62*b* is designed to be less than the width of the sheets $Sh_1$ and $Sh_2$, and a finger 66 fixed to the actuator arm 65 extends into the plane of the bite of the rollers 62*a* and 62*b* beyond an end of the rollers 62*a* and 62*b*. As a copy sheet passes through the rollers 62*a* and 62*b*, the leading edge of the sheet engages with the finger 66 rotating the finger 66 and actuator arm 65 clockwise so that the end of the actuator arm 65 engages with an actuator DSWA of a discharge switch DSW.

In operation, a scan start switch SW1 (FIG. 11) is pressed, and the scanning system SCAN begins its scan movement. The feed rollers 10 and 110 are then driven to feed a sheet $Sh_{10}$ or $Sh_{20}$ from whichever cassette 6 or 106 is selected into the bite of the register rollers 37 and 38. After the sheet has slightly buckled, the feed rollers 10 and 110 are stopped. The charging unit 41 charges the photoconductive material Pho of the drum 39 to a positive polarity, and the charge on the drum 39 is dissipated in areas of the material Pho corresponding to light areas of the document Org at the point IMAGE by the scanning system SCAN to form an electrostatic image on the drum 39. The developing liquid introduced into the tray 50 contains negatively charged toner particles which adhere to the areas of the drum 39 in which the charge was not dissipated during imaging to form a toner image on the drum 39.

When the rightmost corner of the mirror 43 reaches a plane A shown in FIG. 6, the leading edge of the toner image on the drum 39 has reached a position slightly below the register rollers 37 and 38. A switch SW4 (FIGS. 8 and 11), which will be described in detail below, is then actuated and causes the register rollers 37 and 38 to rotate. The register rollers 37 and 38 feed the sheet into contact with the material Pho of the drum 39 so that the speed of feed of the sheet is equal to the circumferential speed of the drum 39. The essential feature of the present invention is that the plane A is selected so that the register rollers 37 and 38 are driven at a time so that the leading edge of the sheet being fed thereby contacts the drum 39 in perfect register or alignment with the leading edge of the toner image. The sheet and drums 39, upon further movement, are then subjected to positive corona discharge by the transfer charging unit 51. The positive potential applied through the sheet causes the toner particles to be transferred from the drum 39 to the sheet. As the sheet reaches the belt 56, the leading corner of the sheet is separated from the drum 39 since the belt 56 passes diagonally across the leading corner of the sheet between the sheet and the drum 39. The rollers 52 to 55, 59*a* and 59*b* and 62*a* and are rotatably supported by the frame 1 and 62*b* rotate as indicated by arrows.

As the sheet is lifted from the drum 39 by the belt 56, it moves further so as to be fed between the belt 56 and roller 52 and through the fixing rollers 59*a* and 59*b*, whereby the toner image is thermally fixed to the sheet. The sheet then passes through the discharge rollers 62*a* and 62*b* and is fed thereby into the tray 63. As described above, the leading edge of the sheet actuates the discharge switch DSW.

Figure 11:
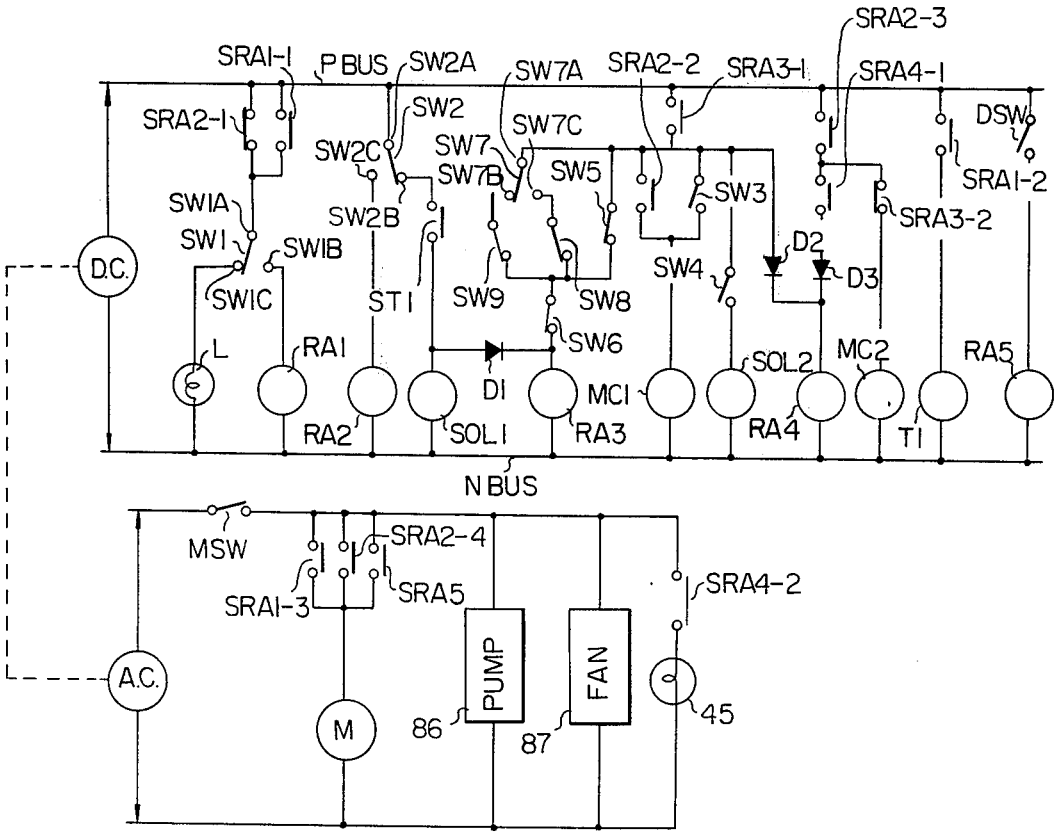
FIG. 11 is a schematic wiring diagram of the copy machine shown in FIG. 1.

Referring now to the electrical circuit diagram disclosed in FIG. 11, an alternating current source AC and a direct current source DC are provided. A drive motor M is connected through the parallel combination of normally open relay contacts SRA1-3, SRA2-4 and SRA5 in series with a main power switch MSW across the source AC. A pump 86 for the developing liquid and a cooling fan 87 are connected in parallel with each other and in series with the switch MSW across the source AC. The lamp 45 of the scanning system SCAN is connected in series with normally open relay contacts SRA4-2 and the switch MSW across the source AC.

A positive bus line PBUS and a negative bus line NBUS are connected to the positive and negative terminals of the source DC respectively. Normally closed relay contacts SRA2-1 and normally open relay contacts SRA1-1 are connected in parallel with each other between the bus line PBUS and a movable contact SW1A of the print switch SW1.

A print ready lamp L is connected between a fixed contact SW1C of the print switch SW1 and the bus line NBUS, and a print hold relay coil RA1 is connected between a fixed contact SW1B of the switch SW1 and the bus line NBUS. A movable contact SW2A of a limit switch SW2 is connected to the bus line PBUS. A scan hold relay coil RA2 is connected between a fixed contact SW2C of the switch SW2 and the bus line NBUS. A fixed contact SW2B of the switch SW2 is connected to the bus line NBUS through normally open timer switch contacts ST1 and a solenoid SOL1. The anode of a diode D1 is connected to the junction between the contacts ST1 and the solenoid SOL1, and the cathode of the diode D1 is connected to the bus line NBUS through a scan direction control relay coil RA3. Normally open relay contacts SRA3-1 are connected at one end to the bus line PBUS, and at the other end through a normally closed half sheet return switch SW5 and a normally closed full sheet return switch SW6 to the cathode of the diode D1. A movable contact SW7A of a cassette selection switch SW7 is connected to the junction between the relay contacts SRA3-1 and the switch SW5. A normally closed B6 indicator switch SW9 is connected between a fixed contact SW7B of the switch SW7 and the junction of the switches SW5 and SW6. A normally closed A6 indicator switch SW8 is connected between a fixed contact SW7C of the switch SW7 and the junction of the switches SW5 and SW6.

A scan magnetic clutch MC1 is connected at one end to the bus line NBUS and at the other end through the parallel combination of normally open relay contacts SRA2-2 and a normally open scan start switch SW3 to the junction of the relay contacts SRA3-1 and the switch SW5. A sensor or register roller release switch SW4 is connected at one end to the junction of the relay contacts SRA3-1 and the switch SW3 and at the other end through a solenoid SOL2 to the bus line NBUS. The anode of a diode D2 is connected to the junction of the relay contacts SRA3-1 and the switch SW4, and the cathode of the diode D2 is connected through a scan lamp control relay coil RA4 to the bus line NBUS. The cathode of a diode D3 is connected to the cathode of the diode D2. Normally open relay contacts SRA2-3 are connected at one end to the bus line PBUS and at the other end through normally open relay contacts SRA4-1 to the anode of the diode D3.

Normally closed relay contacts SRA3-2 are connected at one end to the junction of the relay contacts SRA2-3 and SRA4-1, and at the other end through a scan return magnetic clutch MC2 to the bus line NBUS. Normally open relay contacts SRA1-2 are connected in series with a timer T1 across the bus lines PBUS and NBUS. The discharge switch DSW is normally open and is connected in series with a discharge relay RA5 across the bus lines PBUS and NBUS.

Gearing which is not shown but well known in the art is provided between the motor M, the magnetic clutches MC1 and MC2 and the scanning system SCAN so that the scanning system SCAN is moved from right to left as viewed in FIG. 6 when the magnetic clutch MC1 is energized and from left to right when the magnetic clutch MC2 is energized. Gearing is further provided (not shown) between the motor M and the drum shaft 39a, shaft 52a, rollers 59a and 59b and rollers 62a and 62b to rotate the same at constant speed.

The relay coil RA1 causes the relay contacts SRA1-1, SRA1-2 and SRA1-3 to close when energized. The relay coil RA2 causes the relay contacts SRA2-1, SRA2-2, SRA2-3 and SRA2-4 to open, close, close and close respectively when energized. The relay coil RA3 causes the relay contacts SRA3-1 and SRA3-2 to close and open respectively when energized. The relay coil RA4 causes the relay contacts SRA4-1 and SRA4-2 to close when energized. The relay coil RA5 causes the relay contacts SRA5 to close when energized. When the timer T1 is energized, it causes the contacts ST1 to close after a predetermined time has elapsed, and to close again when the timer T1 is de-energized.

The print switch SW1 is manually pressed or changed to start a copy operation and is automatically reset when the copy operation is finished as will be described in detail below. The limit switch SW2 is shown in FIG. 6 as disposed at the rightward limit of travel (the plane D) of the support 44 and actuated thereby through an actuator SW2AC. When the support 44 is in the plane D as shown, the switch SW2 is as shown in FIG. 11 with the contacts SW2A and SW2B engaged. As the support 44 moves slightly leftward, the support 44 disengages from the actuator SW2AC so that the movable contact SW2A moves to engage with the fixed contact SW2C.

Figure 7:
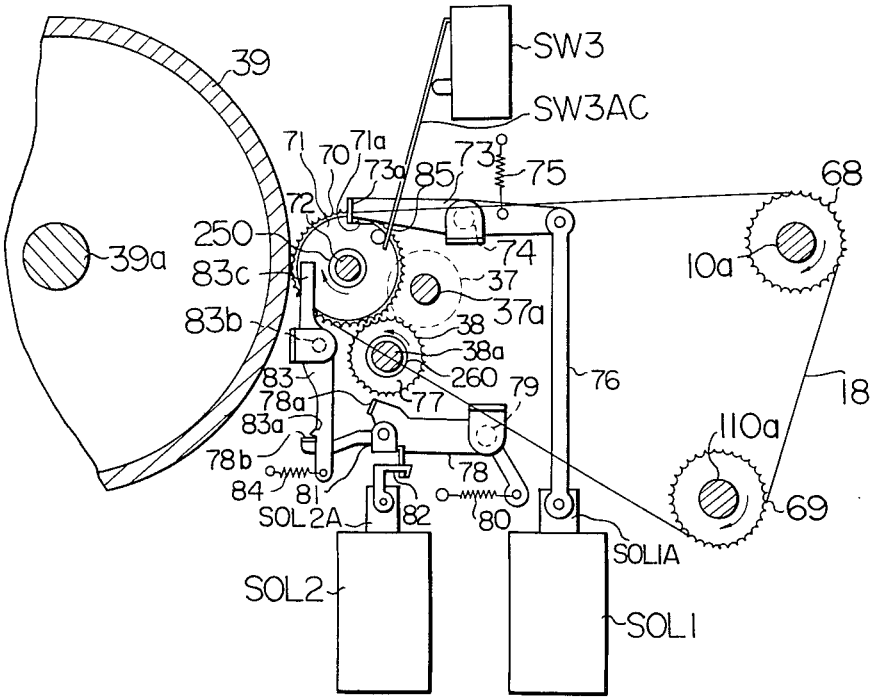
FIG. 7 is a longitudinal section of one embodiment of a copy sheet feed apparatus according to the present invention.

The scan start switch SW3 is shown in FIG. 7, and is normally open, as shown in FIG. 11. Upon rotation of a wheel 71, a pin 85 fixed to the wheel 71 will engage with an actuator SW3AC of the switch SW3 to momentarily close the switch SW3.

Figure 8:
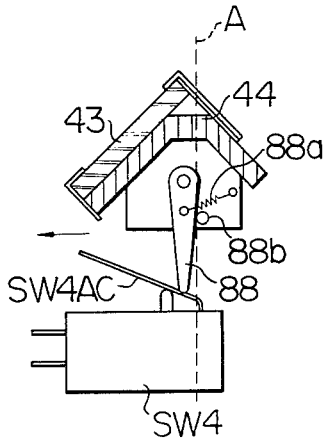
FIG. 8 illustrates a scanning mirror and a switch of the copy machine shown in FIG. 1.

The sensor or register roller release switch SW4 is shown in FIG. 8, and is disposed in the plane A which is shown in FIG. 6. An actuator arm 88 is pivotally connected to the support 44, and is biased counterclockwise against a stop pin 88b by a tension spring 88a which is connected at one end to the support 44 and at the other end to the actuator arm 88. When the support 44 moves leftward and reaches the plane A, the actuator arm 88 engages with an actuator SW4AC of the switch SW4 to momentarily close the switch SW4. The switch SW4 will not be affected by rightward movement of the support 44 since the actuator arm 88 will be rotated clockwise upon engagement with the left end of the actuator SW4AC against the force of the spring 88a.

The half sheet return switch SW5 is disposed in a plane B of FIG. 6, and shown only in FIG. 11. The switch SW5 is actuated in an identical manner by the actuator arm 88 as the switch SW4. The switch SW5 is normally closed, and will be opened when the support reaches the plane B. The switch SW5 causes the scanning system SCAN to terminate movement in the leftward direction when the support 44 reaches the plane B and return to the rightward limit plane A when half size (A6 or B6) sheets are being used.

The full sheet return switch SW6 is identical to the switch SW5, and although shown only in FIG. 11, causes the scanning system SCAN to return to the rightward limit when the support 44 reaches the plane C shown in FIG. 6.

Figure 5:
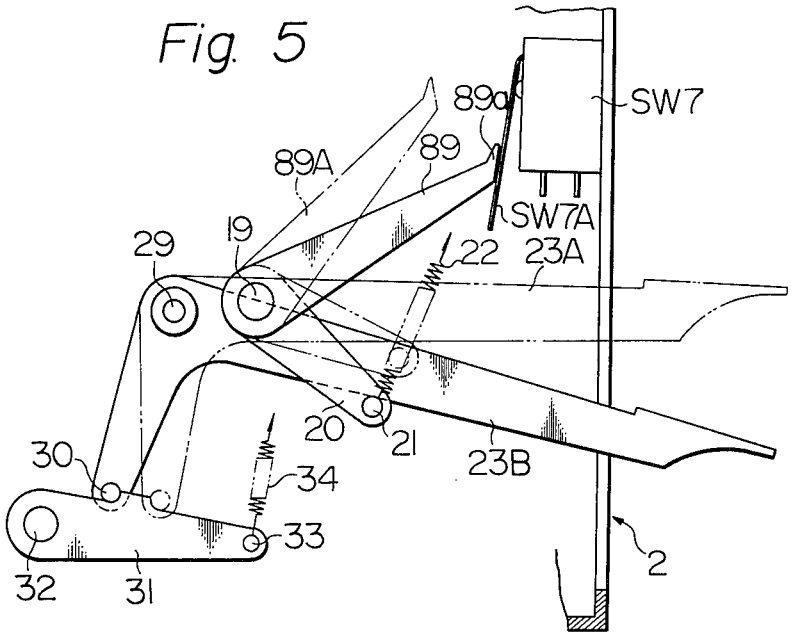
FIG. 5 is a fragmentary longitudinal section of part of the copy machine shown in FIG. 1 in enlarged scale illustrating the operation thereof.
Figure 9:
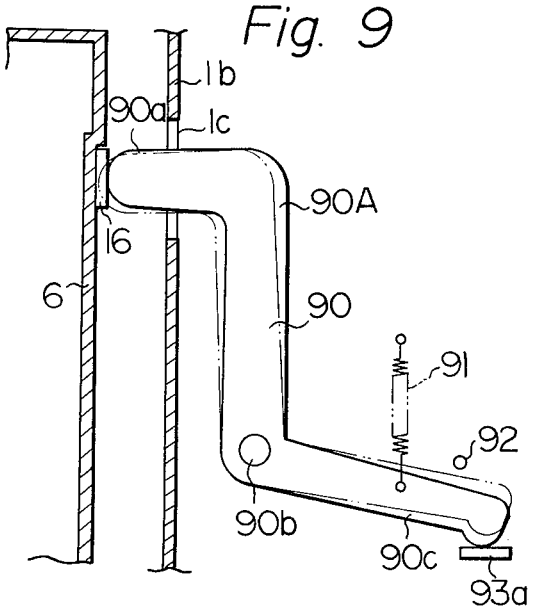
FIG. 9 is a fragmentary elevational section of part of the copy machine shown in FIG. 1 in enlarged scale illustrating the operation thereof.
Figure 10:
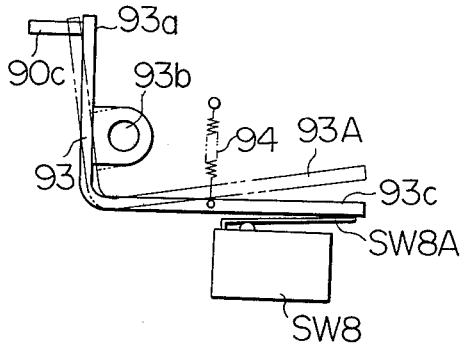
FIG. 10 is a fragmentary elevational section of a part of the copy machine shown in FIG. 1 in enlarged scale cooperating with the part shown in FIG. 9 illustrating the operation thereof.

The cassette selection switch SW7 is shown in FIG. 5, and is actuated through an actuator SW7AC by an arm 89 mounted for rotation with the shaft 19. When the selector lever 23 is rotated clockwise as shown in solid line to select the B size cassette 106, the switch SW7 is as shown in FIG. 11 with the contacts SW7A and SW7B engaged since the arm 89 is rotated to the position shown in solid line and an end **89*a* engages with the actuator SW7AC. When the selector lever 23 is rotated counterclockwise to the position shown in broken line and designated as 23A, the arm 89 is rotated to the broken line position designated as 89A in which the end 89*a* disengages from the actuator SW7AC and the contact SW7A engages with the contact SW7C. The A6 indicator switch SW8 and its actuating mechanism are shown in FIGS. 9 and 10. When it desired to use half size A6 sheets rather than full size A5 sheets, the partitions 14*a* and 14*b* are fixed to the cassette 6 and the A6 paper is placed in the compartment of the cassette 6 bounded by the front wall 6*c*. The indicator plate 16 is fixed to the cassette as shown in FIGS. 3 and 9 to indicate that half size sheets are loaded in the cassette 6. A bell crank lever 90 is pivotal about a pin 90*b* and has arms 90*a* and 90*c*. The arm 90*a* is bent and protrudes through a hole 1*a* formed through a member 1*b* of the frame 1. The lever 90 is biased counterclockwise by a tension spring 91 connected at one end to the frame 1 and at the other end to the arm 90*c* of the lever 90. Excessive counterclockwise movement of the lever 90 is prevented by a pin 92 connected to the frame 1**.

When the indicator plate 16 is fixed to the cassette 6, the left end of the arm **90*a* abuts against the plate 16 so that the lever 90** is in the position shown in solid line.

A bell crank lever 93 is shown in FIG. 10 as pivotal about a pin **93*b* fixed to the frame 1. The lever 93 has arms 93*a* and 93*c* arranged at right angles to each other, and is biased counterclockwise by a tension spring 94 which has one end connected to the frame 1 and the other end connected to the arm 93*c* of the lever 93. The end portion of the arm 93*a* is thereby biased into engagement with the end of the arm 90*c* of the lever 90. With the indicator plate 16 applied, the arm 93*c* engages with an actuator SW8AC of the switch SW8 to open the switch SW8. If the indicator plate 16 is not applied indicating full A5 sheet size, the levers 90 and 93 assume the broken line positions 90A and 93A since the lever 90 rotates slightly clockwise to abut against the side wall of the cassette 6 as viewed in FIG. 9 and the lever 93 rotates slightly clockwise as viewed in FIG. 10. The arm 93*c*** disengages from the actuator SW8AC and the switch SW8 is closed.

The B6 indicator switch SW9 is identical to the A6 indicator switch SW8 and is actuated by an identical mechanism, although not shown, associated with the cassette 106.

Referring now to FIG. 7, novel apparatus embodying the present invention is clearly shown. Sprockets 68 and 69 are connected to the shafts **10*a* and 110*a* of the feed rollers 10 and 110 respectively through one-way clutches (not shown) which allow the shafts 10*a* and 110*a* to rotate only in the clockwise direction relative to the sprocket wheels 68 and 69 respectively. A sprocket 70 and the cam wheel 71 are fixed together and mounted on a shaft 72 through a friction clutch 250. The shaft 72 is driven by the motor M. The cam wheel 71 carries the pin 85 and has a cutout 71*a* formed in the periphery thereof. A chain 18 is trained around the sprocket wheels 68, 69 and 70**.

A pawl lever 73 is rotatably supported by the frame 1 about a pin 74 and has a pawl or engaging portion **73*a* formed at its left end adapted to engage with the cutout 71*a* of the cam wheel 71. The lever 73 is normally biased counterclockwise by a tension spring 75 which is connected at one end to the frame 1 and at the other end to the lever 73 to the right of the pin 74. A plunger SOL1A of the solenoid SOL1 is pivotally connected through a link 76 to the right end of the lever 73. The solenoid SOL1 is fixed to the frame 1. With the solenoid SOL1 deenergized, the pawl 73*a* of the lever 73 is biased by the spring 75 to engage with the cutout 71*a* of the wheel 71 to prevent rotation of the wheel 71 and sprockets 68, 69 and 70**.

The register rollers 37 and 38 are shown in FIG. 7, and are in light pressing contact with each other. The shaft **37*a* is rotatably supported by the frame 1. The shaft 38 is rotatably supported by the frame 1 and is connected to the motor M through a friction clutch 260. A ratchet 77 is fixed to the shaft 38*a*. A pawl 78 is rotatably supported by the frame 1 through a shaft 79, and is biased clockwise by a tension spring 80 connected at one end to the frame 1 and at the other end to the rightmost end of the pawl 78. The solenoid SOL2 is fixed to the frame 1, and a plunger SOL2A of the solenoid SOL2 is pivotally connected to a link 82. A link 81 is pivotally connected to the pawl 78, and engages with the link 82. A keeper lever 83 is pivotally connected to the frame 1 through a pin 83*b*, and is biased clockwise by a tension spring 84 connected at one end to the frame 1 and at the other end to the bottom end of the lever 83. The pawl 78 has an engaging portion 78*a* adapted to engage with the ratchet 77 and an engaging portion 78*b* adapted to engage with an engaging portion 83*a* of the lever 83. Upon rotation of the cam wheel 71, the pin 85 is adapted to engage with the upper end 83***c* of the lever 83 to rotate the lever 83 counterclockwise against the force of the spring 84.

Figure 12:
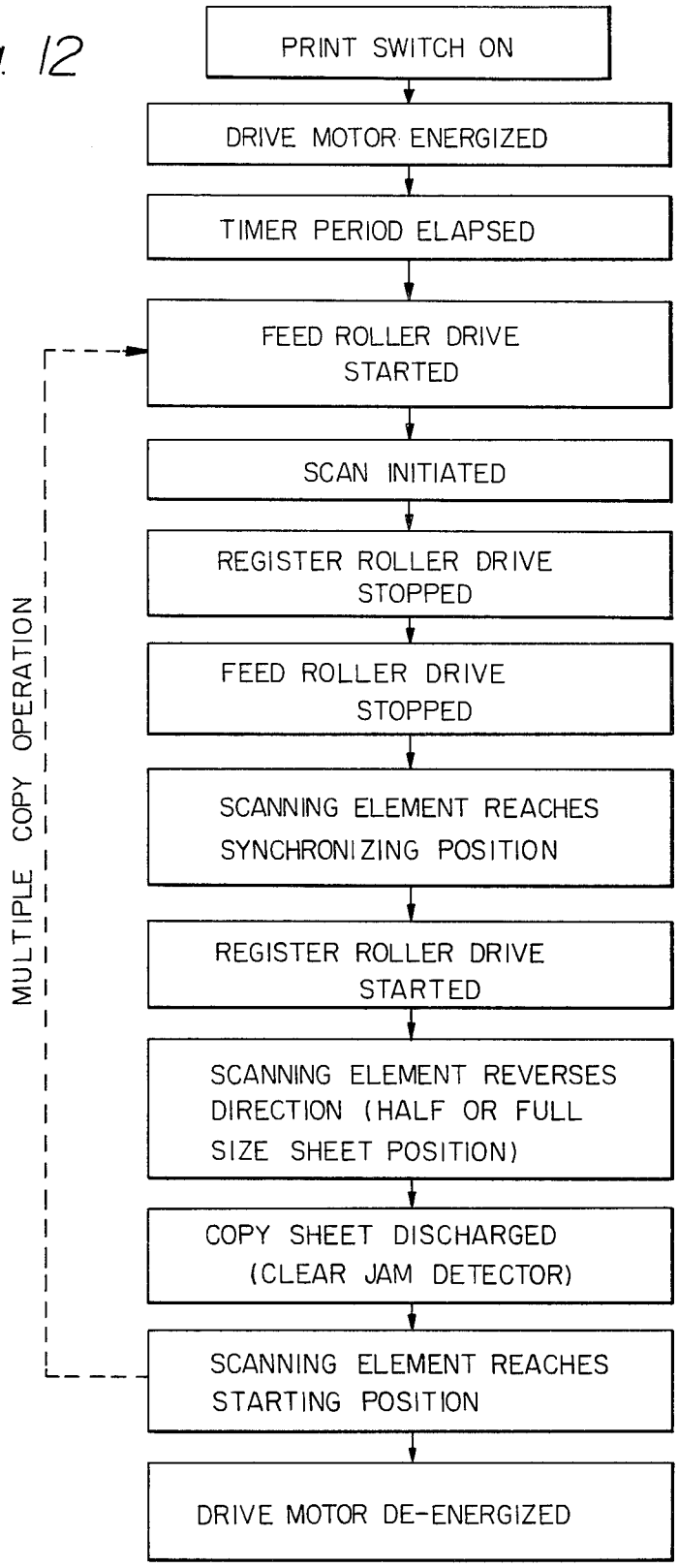
FIG. 12 is a flow chart of the operation of the copy machine shown in FIG. 1.

The operation of the entire apparatus will now be described in detail with reference to the drawings, especially the flow chart of FIG. 12. It will be assumed that the selector lever 23 is rotated clockwise to select the cassette 106 as shown in FIG. 1 and described above. The top sheet $Sh_{20}$ of the sheets $Sh_2$ is in contact with the roller 110 and the sheets $Sh_1$ in the cassette 6 are out of contact with the roller 10. It will also be assumed that the cassette 106 is loaded with B5 sheets so that the B6 indicator switch SW6 is closed. The main power switch MSW is closed, the print ready light L is lighted through the normally closed relay contacts SRA2-1 and print switch SW1.

To perform a copy operation, the print switch SW1 is manually changed or pressed so that the print hold relay RA1 is energized through the relay contacts SRA2-1 and the contacts SW1A and SW1B of the print switch SW1. Upon energization of the relay RA1, the relay contacts SRA1-1, SRA1-2 and SRA1-3 close. The contacts SRA1-1 act as holding contacts for the relay coil RA1. Closure of the contacts SRA1-2 actuates the timer T1. Closure of the contacts SRA1-3 energizes the motor M.

After a predetermined time period which is sufficient for the entire surface of the drum 39 to be rotated by the motor M past a cleaning station (not shown), the timer T1 closes the contacts ST1 which energizes the solenoid SAL1 and the relay coil RA3 through the contacts SW2A and SW2B of the limit switch SW2. Energization of the relay coil RA3 causes the contacts SRA3-1 and SRA3-2 to close and open respectively. The relay contacts SRA3-1 act as holding contacts for the relay coil RA3. The opened contacts SRA3-2 prevent the return magnetic clutch MC2 from being energized. Closure of the contacts SRA3-1 also energizes the scan lamp control relay RA4, which closes its contacts SRA4-1 which act as holding contacts and its contacts SRA4-2 which causes the scan lamp 45 to light and illuminate the document Org.

It will be noticed that the limit switch SW2 is open since the support 44 is in its rightmost position. Referring now to FIG. 7, energization of the solenoid S0L1 retracts the plunger S0L1A which causes the pawl lever 73 to rotate clockwise and the engaging portion 73*a* to disengage from the cutout 71*a* of the cam wheel 71 thereby allowing the cam wheel 71, sprockets 68, 69 and 70 and feed rollers 10 and 110 to rotate. The feed roller 110 moves the sheet $Sh_{20}$ toward the bite of the register rollers 37 and 38.

Slight rotation of the cam wheel 71 causes the pin 85 to engage with the actuator SW3AC of the scan start switch SW3 to momentarily close the switch SW3. Closure of the switch SW3 energizes the scan magnetic clutch MC1 which causes the scanning system SCAN, and especially the support 44 to move leftward to scan the document Org. Leftward movement of the support 44 causes the support 44 to disengage from the actuator SW2AC causing the switch SW2 to change so that its contacts SW2A and SW2C engage, thereby energizing the scan hold relay coil RA2. The solenoid S0L1 is de-energized and is prevented from being energized through the relay contacts SRA3-1 by the diode D1. The spring 75 rotates the pawl lever 73 counterclockwise so that the engaging portion 73*a* contacts the circumference of the cam wheel 71. The cam wheel 71 will rotate by one revolution until the engaging portion 73*a* again drops into the cutout 71*a* to lock the cam wheel 71. The tooth ratios of the sprockets 68, 69 and 70 are selected so that the sheet $Sh_{20}$ will be fed into the bite of the register rollers 37 and 38 and slightly further during one revolution of the cam wheel 71 so that the sheet $Sh_{20}$ is slightly buckled as described above. The pawl 78 is held out of engagement with the ratchet 77 in this condition as shown in FIG. 7 through engagement of the engaging portion 83*a* of the keeper lever 83 and the engaging portion 78*b* of the pawl 78, and the register rollers 37 and 38 are rotated by the motor M.

Energization of the scan hold relay coil RA2 opens the relay contacts SRA2-1 to prevent the print ready lamp L from being lighted during a copying operation even if the print switch SW1 is changed. The contacts SRA2-2 are closed to maintain the scan magnetic clutch MC1 energized after the scan start switch SW3 is opened. The switches SW2 and SW3 are arranged so that the scan start switch SW3 will remain closed until the limit switch SW2 is closed to energize the relay coil RA2. Energization of the relay coil RA2 also closes the relay contacts SRA2-3 to maintain the scan lamp control relay RA4 energized through its holding contacts SRA4-1 after the relay contacts SRA3-1 are opened, as will be understood from description which will follow. The relay contacts SRA2-4 are also closed to prevent the motor M from being de-energized during a copy operation.

The feed rollers 10 and 110 and the register rollers 37 and 38 continue to rotate until the pin 85 engages with the end 83*c* of the keeper lever 83 thereby rotating the keeper lever counterclockwise. This rotation causes the engaging portion 83*a* of the keeper lever 83 to disengage from the engaging portion 78*b* of the pawl 78. The pawl 78, thereby released, is rotated clockwise by the spring 80 into engagement with the ratchet 77 to stop the register rollers 37 and 38. The location of the pin 85 on the cam wheel 71 is such that the feed rollers 37 and 38 will be stopped just before, at the same time, or slightly after the leading edge of the sheet $Sh_{20}$ reaches the bite thereof depending on the geometry of the copy machine, the thickness of the sheets $Sh_2$, and other practical design factors.

In accordance with an important feature of the present invention, when the support 44 reaches the plane A shown in FIG. 6, the register roller release switch SW4 is momentarily closed to energize the solenoid SOL2. This causes the plunger SOL2A of the solenoid SOL2 to rotate the pawl 78 counterclockwise so that the engaging portion 78*b* of the pawl 78 will pass over the bottom edge of the engaging portion 83*a* of the keeper lever 83. Disengagement of the engaging portion 78*a* of the pawl 78 from the ratchet 77 will allow the register rollers 37 and 38 to resume rotation and feed the sheet $Sh_{20}$ into contact with the drum 39 in perfect register or synchronization with the toner image. Although the feed roller 110 is still in contact with the sheet $Sh_{20}$, movement of the sheet $Sh_{20}$ by the register rollers 37 and 38 will cause the feed roller 110 to rotate clockwise due to the provision of the one-way clutch, and thereby not interfere with the movement of the sheet $Sh_{20}$ by the feed rollers 37 and 38. When the register roller release switch SW4 is opened, the pawl 78 will be held out of engagement with the ratchet 77 since the spring 84 maintains the bottom of the engaging portion 83*a* of the keeper lever 83 in holding engagement with the top of the engaging portion 78*b* of the pawl 78.

When the support 44 reaches the plane B, the half sheet return switch SW5 is momentarily opened. This has no effect on the relay coil RA3, however, due to the circuit through the switches SW7 and SW9 which bypasses the switch SW5.

When the support 44 reaches the plane C, the full sheet return switch SW6 is opened thereby which de-energizes the scan direction control relay coil RA3. The contacts SRA3-1 are thereby opened to de-energize the scan magnetic clutch MC1 and terminate advance motion of the scanning system SCAN. The contacts SRA3-2 are closed, which energizes the return magnetic clutch MC2 to move the scanning system SCAN rightward as viewed in FIG. 6, or in the return direction. The scan magnetic clutch MC1 is prevented from being energized under these conditions through the relay contacts SRA2-3 and SRA4-1 by the diode D2.

The print switch SW1, although for simplicity of description means are not shown to provide the function, is adapted to be changed by engagement with a member of the scanning system SCAN during the return movement of the system SCAN before the support 44 actuates the limit switch SW2. The relay coil RA1 is de-energized which opens the contacts SRA1-1, SRA1-2 and SRA1-3. The print ready light L is not lighted since the contacts SRA2-1 are open. Opening of the contacts SRA1-2 resets the timer T1. As the support 44 reaches the plane D, the limit switch S2 is actuated thereby to engage the contacts SW2A and SW2B and de-energize the scan hold relay coil RA2. This causes the contacts SRA2-1 to close and light the print ready light L. The contacts SRA2-2 open to prevent the scan magnetic clutch MC1 from being energized. The relay contacts SRA2-3 open to de-energize the return magnetic clutch MC2 and stop rightward movement of the scanning system SCAN. Opening of the contacts SRA2-3 also de-energizes the scan lamp control relay coil RA4 to de-energize the scan lamp 45. The contacts SRA2-4 are also opened to de-energize the motor M. The diode D3 prevents the return magnetic clutch MC2 from being energized when the contacts ST1 are first closed by the timer T1.

Next, it will be assumed that B6 sheets are loaded in the cassette 106 and that an indicator identical to the indicator 16 is applied to the cassette 106. The B6 indicator switch SW9 is thereby opened. The operation is identical to that described above except that the scan direction control relay coil RA3 is opened when the support 44 reaches the plane B rather than the plane C, since there is in this case no circuitry bridging the half sheet return switch SW5. The full and half sheet operation utilizing the cassette 6 filled with full or half size sheets is essentially similar to that described above, and such description will not be repeated.

Although not shown, a copy counter may be provided whereby when the document Org is inserted into the copy machine, a number is manually set into the counter and the print switch SW1 is pressed, the copy machine will perform the copy operation by the number of times set into the counter to make that number of copies without further attention by the copy machine operator. In this case, the print switch SW1 is adapted to be held in the position with the contacts SW1A and SW1B engaged once the switch SW1 is depressed by the operator by the counter until the end of the last copy operation. In such a case, as the scanning system SCAN reaches the plane A after performing a copy operation and assuming that another copy operation is to be performed, the contacts SW1A and SW1B remain engaged so that the relay coil RA1 remains energized and its contacts SRA1-2 maintain the timer T1 energized. The contacts ST1 thereby remain closed. As the support 44 actuates the limit switch SW2 to engage the contacts SW2A and SW2B, the scan hold relay coil RA2 is de-energized to open its relay contacts SRA2-3 and de-energize the return magnetic clutch MC2. However, since the contacts ST1 are closed, as the contacts SW2A and SW2B of the limit switch SW2 engage, a circuit is completed through the switch SW2 and contacts ST1 to again energize the solenoid SOL1 and scan direction control relay coil RA3. The succeeding copy operation is then thereafter identical to the first except that the cleaning period for the drum 39 provided by the timer T1 is provided only preceding the first copy operation.

The discharge switch DSW is provided to ensure that the motor M will not be de-energized while there is a sheet in the bite of the discharge rollers 62*a* and 62*b.* The motor M will finally be de-energized after the copying operation, for one or a plurality of copies, is completed. The switch DSW will be recognized as providing a jam preventing function.

Figure 13:
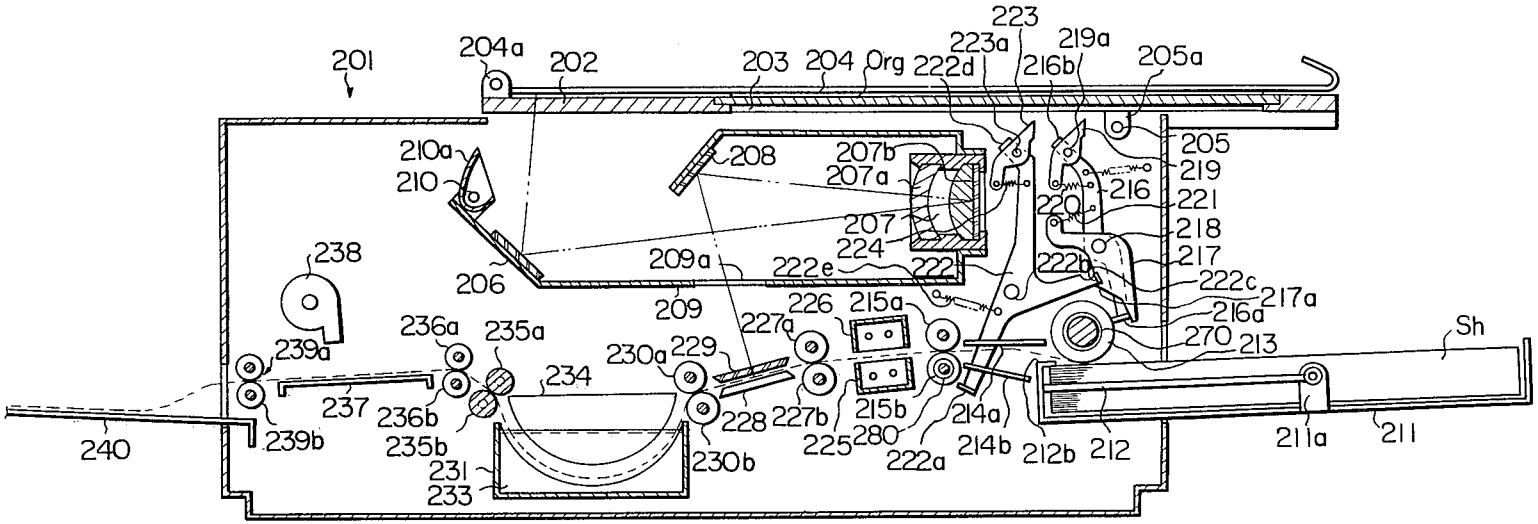
FIG. 13 is a longitudinal section of another copy machine incorporating another embodiment of a sheet feed apparatus according to the present invention.

Referring now to FIG. 13, another embodiment of a copy machine incorporating the present invention is clearly shown as comprising a frame 201. Whereas in the embodiment previously described the original document Org is stationary and the scanning system SCAN is moved, in the embodiment shown in FIG. 13 the scanning system is stationary whereas the document Org is moved.

A carriage 202 is movably mounted on top of the frame 201 by means of guide rails, which are not shown for simplicity of illustration. The carriage 202 is movable from the rightmost position shown in the drawing to a leftmost position (not shown) and back to the rightmost position by drive means (not shown). A transparent plate 203 carried by the carriage 202 supports the document Org which is placed face down as in the previously described embodiment. A cover 204 is hinged to the carriage 202 by a pin 204*a.* An engaging pin 205 is fixed to a bracket 205*a* which is in turn fixed to the carriage 202 and protrudes downward into the interior of the frame 201.

A support 209 is fixed to the frame 201 and mounts a plane mirror 206 below the carriage 202 and disposed at an angle thereto. A lens group 207 is horizontally mounted on the support 206 and comprises a lens 207*a* and a plane mirror 207*b* mounted to the right of the lens 207*a* . A plane mirror 208 is mounted at an angle on the support 206 above and between the mirror 206 and lens group 207. A hole 206*a* is formed through the support 206 below the mirror 208.

A lamp 210 mounted in a reflector 210*a* is fixed to the support 206 and aimed upward to illuminate the document Org.

A sheet tray 211 is fixed to the frame 201 and supports copy sheets Sh. A pawl member 212 is pivotally connected to a support 211*a* of the sheet tray 211 at its right end and carries a separator portion 212*a* at its left end. The pawl member 212 is essentially similar to the pawl member 11 of the previous embodiment. A separator or feed roller 213 contacts the top of the sheets Sh and is driven through a friction clutch 270 by a motor (not shown).

The feed roller 213 is adapted to feed the sheets Sh one at a time between guide plates 214*a* and 214*b* into the bite of register rollers 215*a* and 215*b* in a manner similar to that described with reference to the previous embodiment. In the embodiment shown in FIG. 13, a photoconductive drum is not provided, and the sheets Sh are impregnated or coated with a photoconductive material. Such sheets Sh are well known in the art and will not be described in detail herein.

The register roller 215*a* is rotatably supported by the frame 201 and the register roller 215*b* is connected to the motor through a friction clutch 280. The register rollers 215*a* and 215*b* are arranged to feed the sheets Sh between corona discharge units 225 and 226 fixed to the frame 201 which apply an electrical potential to the opposite sides of a sheet Sh passing therebetween. The sheets Sh are then fed between a transparent plate 229 and a plate 228 fixed to the frame 201 by feed rollers 227*a* and 227*b* which are driven by the motor. As the carriage 202 is moved leftward by the motor, a sheet Sh is moved leftward at the same speed by the feed rollers 227*a* and 227*b*. An image of the document Org is projected onto the upper surface of the sheet Sh by the mirror 206, lens group 207 and mirror 208 to create an electrostatic image of the document Org on the sheet Sh. The sheet Sh is then fed by feed rollers 230*a* and 230*b* into a developing tank 231 fixed to the frame 201 containing developing liquid comprising toner particles. A toner image is formed on the sheet Sh during passage through the developing tank 231, and movement of the sheet Sh is guided by a guide fin 233 and a guide plate 234.

After emerging from the developing tank 231, the sheet Sh passes through squeeze rollers 235*a* and 235*b* which squeeze a good portion of the developing liquid out of the sheet Sh. The sheet Sh is then fed by feed rollers 236*a* and 236*b* over a guide plate 237 and between feed rollers 239*a* and 239*b* onto a collecting tray 240 fixed to the frame 201. A blower 238 fixed to the frame 201 is disposed above the guide plate 237 and adapted to blow hot air onto the sheet Sh to dry the same and fix the toner particles thereto. The rollers 227*a*, 227*b*, 230*a*, 230*b*, 235*a*, 235*b*, 236*a*, 239*a* and 239*b* are rotatably supported by the frame 201 and driven by the motor.

In accordance with an important aspect of the present invention, a lever or finger 216 is rotatably supported by the frame 201 about a pin 218. An engaging lever 219 is pivotally connected to the upper end of the finger 216 by a pin 219*a*. A tension spring 220 is connected at its ends to the lower end of the lever 219 and the finger 216, and biases the lever 219 counterclockwise into engagement with a stop 216*b* formed on the upper end of the finger 216. The finger 216 has fixed to its lower end an engaging member 216*a* which is adapted to engage with the feed roller 213 or a member such as a ratchet (not shown) fixed to the feed roller 213 to prevent rotation of the feed roller 213. A tension spring 216*c* connected at its ends to the frame 201 and the finger 216 above the pin 218 biases the finger 216 clockwise so that the engaging portion 216*a* is urged to engage with the feed roller 213. A latch lever 217 is pivotally mounted on the pin 218 and is biased clockwise by a tension spring 221 connected at its ends to the frame 201 and the upper end of the latch lever 217. Excessive clockwise movement of the latch lever 217 is prevented by abutment of the left side of its lower end portion against the right side of the engaging portion 216*a* of the finger 216.

Another lever or finger 222 is rotatably supported by the frame 201 about a pin 222*b*, and has fixed to its lower end an engaging portion 222*a* adapted to engage with the register roller 215*b* or a member such as a ratchet (not shown) fixed thereto to prevent movement of the register rollers 215*a* and 215*b*.

A tension spring 222*e* is connected at its ends to the frame 201 and to the finger 222 below the pin 222*b* to bias the finger 222 clockwise so that the engaging portion 222*a* is urged to engage with the register roller 215*b*. An engaging lever 223 is pivotally connected to the finger 222 by a pin 223*a*, and is biased counterclockwise into engagement with a stop 222*d* formed on the upper end of the finger 222 by a tension spring 224 which is connected at its ends to the bottom end of the engaging lever 223 and the finger 222. A rightwardly extending arm of the finger 222 has formed on its end an engaging portion 222*c* which is adapted to engage with an engaging portion 217*a* formed on the latch lever 217.

In operation, with the carriage 202 in the rightmost position as shown in FIG. 13, the motor is energized to move the carriage 202 leftward. The engaging portion 222*c* of the finger 222 is engaged with the engaging portion 217*a* of the latch lever 217 so that the finger 222 is held in a counterclockwise position as shown against the force of the spring 222*e* so that the engaging portion 222*a* is disengaged from the register roller 215*b* and the register rollers 215*a* and 215*b* are rotated by the motor. The finger 216 is biased clockwise by the spring 216*c* so that the engaging portion 216*a* engages with the feed roller 213 to prevent rotation of the same.

When the carriage 202 has moved leftward to the point at which the pin 205 engages with the upper portion of the engaging lever 219, the engaging lever 219, finger 216 and latch lever 217 are rotated counterclockwise thereby as a unit. The engaging portion 216*a* disengages from the feed roller 213 to release the feed roller 213 for rotation, and the feed roller 213 feeds the top sheet Sh into the bite of the register rollers 215*a* and 215*b*. Rotation of the latch lever 217 causes the engaging portion 217*a* thereof to disengage from the engaging portion 222*c* of the finger 222, so that the finger 222 is released and is rotated clockwise by the spring 222*e* so that the engaging portion 222*a* engages with the register roller 215*b* to stop the same. The finger 216 and latch lever 217 are arranged relative to the speed of movement of the carriage 202 so that the leading edge of the sheet Sh reaches the bite of the register rollers 215*a* and 215*b* just before, at the same time, or slightly after the register rollers 215*a* and 215*b* are stopped.

Upon further leftward movement of the carriage 202, the pin 205 rides over the top of the engaging lever 219 so that the engaging lever 219, finger 216 and latch lever 217 are released and rotated clockwise by the spring 216*c* so that the engaging portion 216*a* of the finger 216 engages with the feed roller 213 to stop the same. The arrangement is such that the feed roller 213 will be stopped slightly after the leading edge of the sheet Sh reaches the bite of the register rollers 215*a* and 215*b* so that the sheet Sh will be resiliently buckled and thereby urged into the bite of the register rollers 215*a* and 215*b*.

Upon further leftward movement of the carriage 202, the pin 205 engages with the engaging lever 223 to rotate the engaging lever 223 and finger 222 counterclockwise as a unit. This causes the engaging portion 222*a* of the finger 222 to disengage from the register roller 215*b* so that the register rollers 215*a* and 215*b* are released for rotation by the motor to feed the sheet Sh between the corona discharge units 225 and 226. Upon further leftward movement of the carriage 202, the engaging portion 222*c* of the finger 222 engages with the engaging portion 217*a* of the latch lever 217. Overtravel of the finger 222 for engagement with the latch lever 217 is allowed due to the provision of the spring 221. Upon further leftward movement of the carriage 202, the pin 205 rides over the top of the engaging lever 223 to release the engaging lever 223 and finger 222. However, the finger 222 is held by the latch member 217 so that the engaging portion 222*a* is maintained out of engagement with the register roller 215*b* so that the register rollers 215*a* and 215*b* continue to rotate and feed the sheet Sh.

The direction of movement of the carriage 202 is reversed at its leftmost limit, and the carriage 202 returns to the rightmost position shown in FIG. 13. Rightward movement of the carriage 202 does not, however, affect the fingers 216 and 222 since engagement of the pin 205 with the engaging levers 223 and 219 under these conditions causes the engaging levers 223 and 219 to rotate clockwise against the forces of the springs 224 and 220 while the fingers 222 and 216 remain stationary respectively.

From the foregoing description, it will be understood that the present invention may be embodied in a number of different ways, and that the invention is applicable to any copy machine in which a copy sheet is fed in synchronism with the movement of an element of a scanning system. It is further irrevelant as to whether a photoconductive drum, plate or belt is provided or not, and as to whether a focussing member is moved while the original document is held stationary or whether the focussing member is held stationary while the original document is moved during scanning. The polarities of the charging units and toner particles as described are exemplary, and may be changed to meet a specific application.

What is claimed is:

1. An electrophotographic copying machine comprising, in combination:

scanning means for scanning an original document;

a seamless photoconductive member moving at constant speed and imaged by the scanning means, first drive means for moving a copy medium from a storage position to a synchronizing position;

second drive means for moving the copy medium from the synchronizing position into contact with said photoconductive member to receive an image of the document produced by the scanning means, the image being transferred to the copy medium as the copy medium is moved in contact with the photoconductive member by the second drive means;

sensing means responsive to the scanning means and operative to sense when the scanning means reaches a predetermined scan synchronizing point;

control means operative to actuate the scanning means to initiate scanning and actuate the first drive means to move the copy medium from the storage position to the synchronizing position in a length of time less than that required for the scanning means to reach the scan synchronizing point; and actuating means responsive to the sensing means and operative to actuate the second drive means when the scanning means reaches the scan synchronizing point, so that the copy medium is moved by the second drive means in synchronism with the operation of the scanning means.

2. The machine according to claim 1, in which the copy medium is a sheet of copy paper, the first drive means comprises a feed roller and the second drive means comprises two register rollers, the feed roller being actuated by the control means to move the copy sheet from the storage position to the synchronizing position at which the leading edge of the copy sheet is inserted into the bite of the register rollers and the copy sheet is resiliently buckled.

3. The machine according to claim 2, in which the control means comprises a friction clutch connecting the feed roller to a prime mover and latch means operative to normally prevent the feed roller from rotating and to allow the feed roller to rotate through a predetermined angle when actuated in response to the initiation of scanning.

4. The machine according to claim 3, in which the latch means comprises a rotatable member rotatable with the feed roller and a latch member, the rotatable member and the latch member being provided with engaging portions which are engageable with each other.

5. The machine according to claim 4, in which the actuating means comprises a friction clutch connecting one of the register rollers with the prime mover, a ratchet fixed for rotation with said one of the register rollers, a pawl biased toward engagement with the ratchet, an actuating member actuated by the sensing means to move the pawl out of engagement with the ratchet when the scanning means reaches the scan synchronizing point and a keeper member arranged to hold the pawl out of engagement with the ratchet when the pawl is moved out of engagement with the ratchet by the actuating member, the rotatable member of the latch means of the control means being provided with another engaging portion arranged to engage with the keeper member to actuate the keeper member to release the pawl when the feed roller has rotated through another predetermined angle smaller than said predetermined angle.

6. The machine according to claim 5, in which the keeper member is a spring biased lever having an engaging portion formed thereon engageable with an engaging portion formed on the pawl.

7. The machine according to claim 1, in which the copy medium is photoconductive and is moved by the second drive means for imaging by the scanning means.

8. The machine according to claim 2, in which the scanning means comprises a scanning element which is moved during scanning, and in which the control means comprises:

a friction clutch connecting the feed roller with a prime mover; and a first lever biased toward engagement with the feed roller to prevent rotation of the feed roller, and in which the actuating means comprises:

another friction clutch connecting one of the register rollers to the prime mover; and a second lever arranged downstream of the first lever in the direction of movement of the scanning element and biased toward engagement with one of said register rollers to prevent rotation of said one register roller;

the first and second levers being formed with engaging portions which are engageable with each other, and the scanning element being engageable with the first and second levers whereby, prior to scanning the first lever is biased into engagement with the feed roller to prevent rotation of the feed roller and the engaging portions of the first and second levers are engaged to hold the second lever out of engagement with said one register roller;

upon initiation of scanning by the control means, the scanning element moves into engagement with the first lever to move the first lever out of engagement with the feed roller to release the feed roller for rotation and move the engaging portion of the first lever out of engagement with the engaging portion of the second lever to release the second lever to engage with said one register roller to prevent rotation of said one register roller;

upon further movement of the scanning element, the scanning element disengages from the first lever to release the first lever to engage with the feed roller to prevent rotation of the feed roller; and upon further movement of the scanning element, the scanning element engages with the second level to move the second lever out of engagement with said one register roller for rotation, the engaging portion of the second lever engaging with the engaging portion of the first lever to be held thereby out of engagement with said one register roller.

9. The machine according to claim 8, in which the scanning element is a movable carriage supporting the original document.

* * * * *